United States Patent [19]

Unander-Scharin

[11] Patent Number: 4,793,619

[45] Date of Patent: Dec. 27, 1988

[54] FLIP OUT GAME AND GAME PIECE

[75] Inventor: Hans Unander-Scharin, Forest Road Wolfeboro, N.H.

[73] Assignee: Anjar Company, New York, N.Y.

[21] Appl. No.: 849,462

[22] Filed: Apr. 8, 1986

Related U.S. Application Data

[63] Continuation-in-part of Ser. No. 744,109, Jun. 12, 1985, abandoned.

[51] Int. Cl.[4] ..... A63F 9/04

[52] U.S. Cl. ..... 273/428; 273/146

[58] Field of Search ..... 273/146, 341, 428

[56] References Cited

U.S. PATENT DOCUMENTS

| | | | |
|---|---|---|---|
| 973,595 | 10/1910 | Wahlin | 273/146 |
| 1,054,341 | 2/1913 | Cowles | 273/146 |
| 1,795,562 | 3/1931 | King et al. | 273/146 |
| 2,238,079 | 4/1941 | Schieb | 273/146 UX |
| 3,400,932 | 9/1968 | Conrad | 273/146 |
| 3,649,017 | 3/1972 | Kirkpatrick | 273/341 |
| 3,871,651 | 3/1975 | Garcia et al. | 273/341 X |
| 3,904,208 | 9/1975 | Grossman | 273/146 |
| 4,093,226 | 6/1978 | Priestle | 273/341 |
| 4,516,776 | 5/1985 | Nicholas | 273/146 |
| 4,546,978 | 10/1985 | David | 273/146 |

FOREIGN PATENT DOCUMENTS

| | | | |
|---|---|---|---|
| 501613 | 11/1954 | Italy | 273/146 |

OTHER PUBLICATIONS

Scarne, John; Scarne's Encyclopedia of Games, 1973, p. 481.

*Primary Examiner*—Paul E. Shapiro

*Attorney, Agent, or Firm*—Wolf, Greenfield & Sacks

[57] ABSTRACT

A game of chance and skill comprising a multiple sided game piece containing a movable weight wherein all but one side has a different surface area and a number. One side has the designation "FLIP OUT". The game is played by placing the game piece on the edge of a surface, flipping it so that it turns around at least a 180°, and adding up the numbers on the upper surface until a player reaches a total of twenty-one points, or any other pre-designated value. Preferably, each player gets three flips per turn unless the "FLIP OUT" designation is thrown, in which case all the points for that turn are forfeited.

11 Claims, 3 Drawing Sheets

FLIP OUT GAME AND GAME PIECE

This is a continuation-in-part of application Ser. No. 744,109, filed June 12, 1985, entitled "FLIP OUT GAME AND GAME PIECE", now abandoned.

BACKGROUND OF THE INVENTION

This invention relates to games and particularly to a game in which a weighted, multi-sided game piece is flipped and points accumulated towards a designated goal by adding the numbers on the top side.

Numerous games exist in which a game piece such as a die is rolled or tossed to reveal one of several faces each with a different number. Variations on this have been developed wherein letters or phrases or instructions are substituted for numbers. In general, these games rely on chance as to which side of the game piece is upright after the piece is tossed, since all the sides of the piece is evenly distributed.

Games utilizing a game piece containing a weight which is freely movable throughout the same piece are also well known. An example of a game employing a hollow cube containing a pair of dice is taught by U.S. Pat. No. 2,528,029 to Brown. An example of a multi-sided game piece containing a freely movable weight is shown by U.S. Pat. No. Des. 221,669 to Sector. These game pieces are characterized by the symmetry of the shape of their respective sides, each face being a square. The relative probability of such a piece being flipped and landing on any one side is strictly a function of chance.

It is therefore an object of the present invention to provide a game and game piece wherein the skill, as well as the luck, of the player is a factor in the outcome of the game.

Another object is to provide a highly compact, one piece game.

A further object is to provide a game and game piece with the foregoing advantages that is also highly portable and can be played on any flat surface with at least one edge.

Still another object is to provide a game piece with the foregoing advantages that also has a low cost of manufacture and can be adapted for use in a variety of games.

SUMMARY OF THE INVENTION

The present invention includes a game piece and a game played by any number of players. In the preferred form of the game, the object is to reach twenty-one points or any other number agreed upon by the players. The game is played by manually flipping the game piece, which has been placed so that it overhangs the edge of a surface, so that it rotates at least 180° before landing on the surface. The numbers showing on the top side of the piece after eaoh flip are added cumulatively.

In the preferred embodiment, the game piece has six sides, with all but two of its six sides having a different surface area. Preferably a single number appears on all but one side which genrally corresponds in magnitude to the difficulty of flipping the piece with that number facing upwardly. One side, in the preferred form, has the words "FLIP OUT". The side opposite the "FLIP OUT" side has the number "1" and has the same surface area as the FLIP OUT side. The game piece also contains a movable weight located within a hollow space within the game piece. In the preferred embodiment, the weight is located within a containing piece, preferably comprised of plastic, having overall dimensions that corresponds to the interior dimensions of the game piece. The containing piece fits within the game piece. An elongated hole within the containing piece allows the weight to move along substantially only one direction, typically a longitudinal axis centrally located with respect to the game piece. The edges of the piece can be rounded, but they are preferably square. The piece is preferably formed of a rigid, durable plastic material.

In a preferred game utilizing this game piece, each player gets three flips per turn beginning with the FLIP OUT side of the game piece facing upwardly before each flip and the game piece resting flatly on the playing surface with a portion overhanging the surface. If the side with "FLIP OUT" lands facing upwardly on the first or second flip, the player loses any points accumulated during that turn plus any remaining flips. If a player flips a number, he has the option of using the remaining flips in his turn or waiving the remaining flips and keeping the amount of points he already has. Points are accumulated from turn to turn until the desired point total is reached or exceeded.

DETAILED DESCRIPTION OF THE INVENTION

Figure 1:
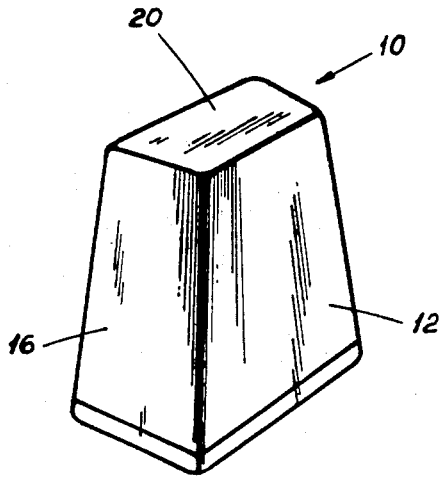
FIG. 1 is a perspective view of the weighted game piece.

As shown in FIG. 1, the preferred embodiment of the game piece 10 consists of six sides or faces, all but two of the sides having a different surface area. The sides are shown in FIGS. 3–8. Each side has indicia, either a number or word. In one embodiment, one side 14 is labelled "FLIP OUT". The side opposite the "FLIP OUT" side has a number such as the "1" shown in FIG. 5. Another side 16 may have the number "3". The side 18 opposite the one labelled "3" may have the number "5". The side 20 is numbered "7". The side 22 is numbered "9".

Figure 2:
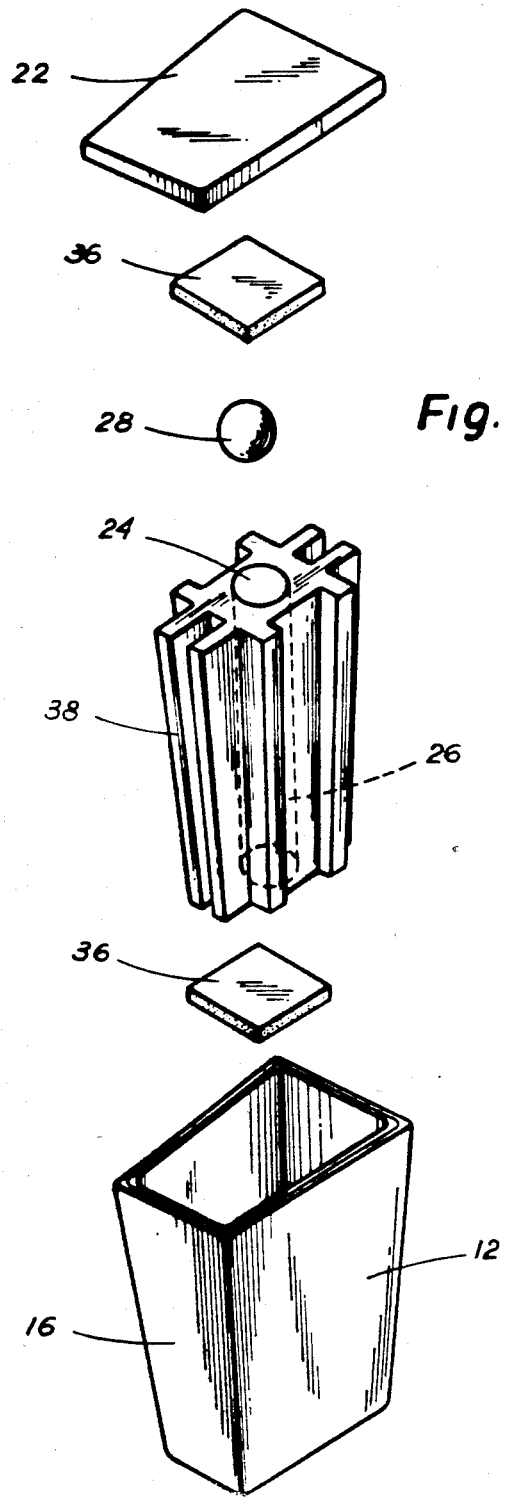
FIG. 2 is an exploded view of the preferred embodiment of the game piece.
Figure 3:
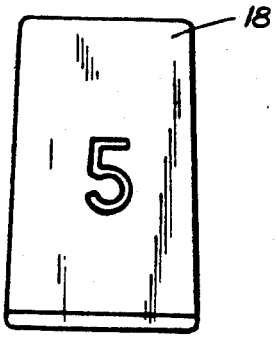
FIGS. 3–8 are plan views of the different sides of the game piece of FIG. 1.
Figure 4:
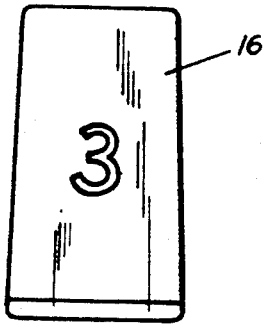
Figure 5:
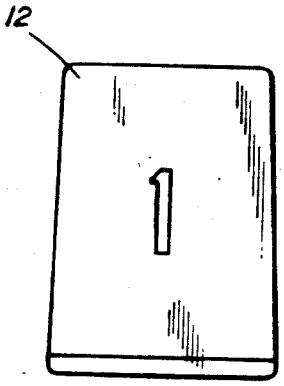
Figure 6:
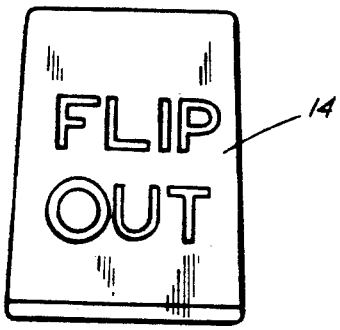
Figure 7:
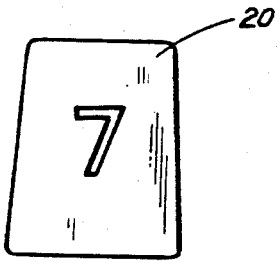
Figure 8:
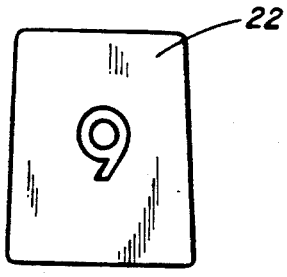

As shown in FIG. 2, containing piece 38 has a hole 24 which extends through its length forming a bore 26 through the interior of the game piece 10. In the preferred form, containing piece 38 is fitted within the game piece 10 and extends generally along the central axis of the game piece 10. Inside the bore 26, a weight 28, such as a ball or other freely movable weight, repositions itself within the game piece 10 as it is flipped. In the preferred embodiment, the weight is round so that it imparts more stability to the piece as it lands on the flat surface. The hole 24, at both ends, is covered with foam strips 36, or the like, in order to reduce noise that would be caused by weight 28 making contact with the interior of playing piece 10 when the piece 10 is flipped.

The game is played by any number of players. The object is to reach twenty-one points or any other number which may be decided upon by the players. The game is played by flipping the game piece which has been placed on the edge of a surface, such as a table top, with the FLIP OUT side. facing upwardly. The piece must rotate at least 180°.

The game may be played on any level surface. Due to the small size of the game piece, it may be conveniently carried in a purse or pocket and the game played on an airplane or in a car.

Figure 9:
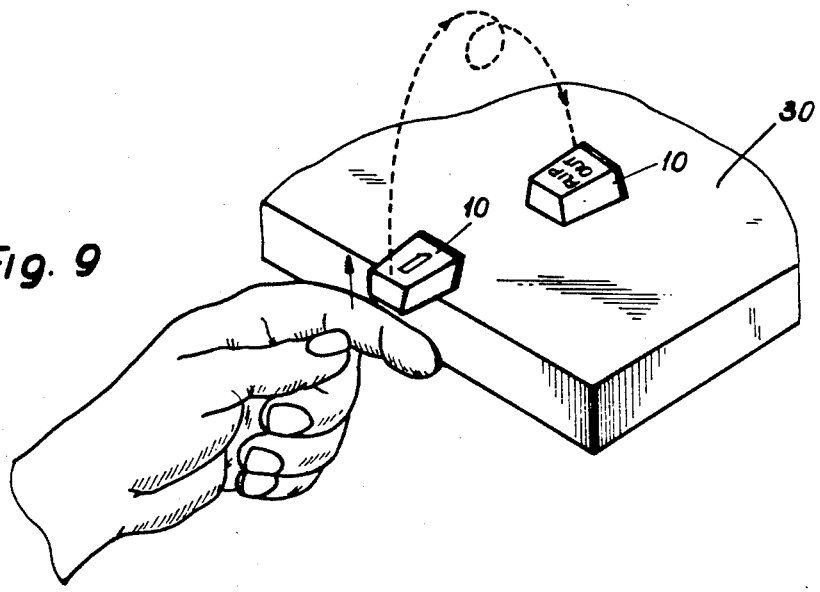
FIG. 9 is a view in perspective of the game piece of FIG. 1 being used in play.

As shown in FIG. 9, the game piece is placed at the edge of a surface 30 so that one edge protrudes out into space. Each player gets three flips per turn. If a "FLIP OUT" shows on the first or second flip, the player loses any points accumulated during that turn plus any remaining flips. Points are acquired by adding the numbers on the upper surface of the game piece 10. If a player flips a number, he has the option of using the remaining flips in his turn or waiving the remaining flips and keeping the amount of points he has already accumulated. When his next turn comes, he will start with the number of points he has previously accumulated.

The highest number is located on the side 22 opposite the side 20 with the smallest surface area. The number of points scored on any given flip corresponds to the degree of difficulty in getting the game piece 10 to land on a particular side. Only one point is scored when the piece lands on the "FLIP OUT" side 14 and no points are scored when the piece lands on the "1" side 12.

The first player that reaches or exceeds twenty-one, or any other total picked by the players, wins the game. For a flip of the game piece to be counted, the game piece must initially be placed with the "FLIP OUT" side 14 up; the game piece must rotate at least 180° in any direction; and the game piece must land and stay on the original flat surface 30. If all three conditions are not met, the turn is treated as a "FLIP OUT". Any flat surface may be used as long as there is room for the piece to extend out from the surface so the player can get under the game piece to flip it.

In a "drinking game" variation, flipping the number "9" side 22 means that the player gets a free drink. Other variations involve the use of playing chips or wagering as to the score or who the winner is.

In one embodiment, the game piece 10 may have overall dimensions at its widest points of approximately 13/16 inches by 1½ inches. The game piece is preferably made by injection molding or extrusion techniques from any rigid, readily molded plastic, although any material may be used. For example, in a more "exotic" version, it may be made out of a solid wood block, with a round bore drilled through the game piece 10 lengthwise, shown as the bore 26, with a weight 28 blocked in. The weight, preferably lead or other dense, heavy material serves both to alter the way the piece flips and to provide stability once the piece lands on the surface. Any shape of weight may be used so long as it is movable within the open space. Since the weight moves during the flip, it adds as a variable the moving center of mass, which requires a greater level of skill to successfully play with the game piece.

Variations of the game "FLIP OUT" and other embodiments of the game piece will occur to those skilled in the art from the foregoing detailed description and accompanying drawings. Such modifications and variations are intended to fall within the scope of the appended claims.

What is claimed is:

1. A game comprising:

providing a game piece having sides of different surface area and including indicia, including numbers, thereon and a space within said game piece, wherein said space contains a movable weight;

providing a generally flat playing surface having at least one open edge;

placing the game piece on the playing surface with a first side of said game piece abutting the surface with a portion of said game piece overhanging the surface at the edge;

flipping said game piece at least 180° so that said piece lands on the flat surface with one side in a face-abutting relationship; and adding the numbers on the upper side until a predetermined total is reached.

2. The game of claim 1 wherein said game piece is flipped by the player three times per turn.

3. The game of claim 1 wherein said game piece has one side denoted "FLIP OUT" and different numbers designated on each of said remaining sides and wherein if the "FLIP OUT" side is upright at the end of the first or second toss, the player loses any points accumulated during that turn.

4. The game of claim 1 wherein said numbers are located on said sides according to the size of said side, wherein the lowest number is on the side opposite the side with ihe largest surface area and largest number is on the side opposite the side with the smallest surface area.

5. The game of claim 4 wherein said game piece is placed on the flat surface with the lowest number designation facing upwardly.

6. A game piece comprising a rigid structural material having:

a plurality of sides, not more than two of said sides having the same surface area;

a hollow space extending generally along a central axis of said game piece as a cylindrical bore;

a weight, disposed within said hollow space and movable within said game piece in response to forces applied to said game piece; and indicia marked on each of said sides; said game piece being adapted to be flipped and said indicia on a side corresponding to the relative difficulty of landing with that side facing upwardly when said game piece is flipped.

7. The game piece of claim 6 wherein said indicia on one side is "FLIP OUT" and different numbers on each of said remaining sides.

8. The game piece of claim 7 wherein said indicia are "1", "3", "5", "7", "9" and "FLIP OUT".

9. The game piece of claim 8 wherein "1" is on the side with the largest surface area, wherein "FLIP OUT" is on the side opposite the side with the largest surface area and "9" is on the side opposite the side with the smallest surface area.

10. The game piece of claim 6 wherein said weight is a metal ball.

11. The game piece of claim 6 wherein said weight is a metal oblong.

* * * * *